US008585327B2

(12) United States Patent
Thurner et al.

(10) Patent No.: US 8,585,327 B2
(45) Date of Patent: Nov. 19, 2013

(54) APPARATUS FOR PLACING FOUNDATION DEVICES, AND/OR PIPES, AND/OR AUGERS INTO THE GROUND, AS AN ATTACHMENT FOR THE BOOM OF A CONSTRUCTION VEHICLE

(75) Inventors: Guenther Thurner, Strasskirchen (DE); Martin Thurner, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 220 days.

(21) Appl. No.: 12/990,174

(22) PCT Filed: May 6, 2009

(86) PCT No.: PCT/EP2009/055499

§ 371 (c)(1),
(2), (4) Date: Dec. 22, 2010

(87) PCT Pub. No.: WO2009/135884

PCT Pub. Date: Nov. 12, 2009

(65) Prior Publication Data

US 2011/0091285 A1 Apr. 21, 2011

(30) Foreign Application Priority Data

May 7, 2008 (DE) ..... 10 2008 022 478

(51) Int. Cl.
*E02D 7/00* (2006.01)

(52) U.S. Cl.
USPC ..... 405/232; 405/229; 405/184.4

(58) Field of Classification Search
USPC ..... 405/229, 232, 252.1, 253, 254, 184.4, 405/184, 174
See application file for complete search history.

(56) References Cited

U.S. PATENT DOCUMENTS

| | | | | |
|---|---|---|---|---|
| 3,746,104 | A | 7/1973 | McIntosh et al. | |
| 4,199,033 | A * | 4/1980 | Van Gundy, Jr. | 173/192 |
| 4,890,680 | A * | 1/1990 | Porsfeld | 173/42 |
| 5,507,354 | A | 4/1996 | Harleman | |
| 5,568,997 | A * | 10/1996 | Raunisto | 405/232 |

(Continued)

FOREIGN PATENT DOCUMENTS

| | | |
|---|---|---|
| AT | 387 424 | 1/1989 |

*Primary Examiner* — Frederick L Lagman
(74) *Attorney, Agent, or Firm* — Jordan and Hamburg LLP

(57) ABSTRACT

An apparatus for placing foundation devices and/or pipes and/or augers in the ground, as an attachment to be attached to the boom of a construction vehicle, including a mounting hinged to a coupling point of the boom, and a drive head, which is rigidly connected to the mounting and configured as a rotational driving and/or drilling and/or impact drilling and/or pile-driving drive and to which the foundation device/pipe/auger for placement in the ground can be coupled. The coupling point can be displaced with respect to the drive head in at least one first direction which is transverse to the longitudinal axis of the foundation device/pipe/auger, and optionally in a second direction, which is transverse to the first direction. The mounting can be a universal joint in which a first joint axis extends so that a first and a second joint part can be displaced thereon, relative to each other, in the first direction, so as to displace the coupling point. A second joint axis may extend so that the second and a third joint part can be displaced thereon, relative to each other, in the second direction.

10 Claims, 5 Drawing Sheets

(56) References Cited

U.S. PATENT DOCUMENTS

| | | | | |
|---|---|---|---|---|
| 6,280,119 | B1 * | 8/2001 | Ryan et al. | 405/175 |
| RE37,661 | E * | 4/2002 | Raunisto | 405/232 |
| 6,942,430 | B1 | 9/2005 | Suver | |
| 7,771,140 | B2 * | 8/2010 | Jinnings et al. | 405/184.4 |
| 2003/0146021 | A1 | 8/2003 | Palm | |
| 2004/0177979 | A1 * | 9/2004 | Rubie et al. | 173/39 |
| 2005/0201836 | A1 | 9/2005 | Suver | |
| 2010/0296872 | A1 * | 11/2010 | Jinnings et al. | 405/184.4 |

* cited by examiner

APPARATUS FOR PLACING FOUNDATION DEVICES, AND/OR PIPES, AND/OR AUGERS INTO THE GROUND, AS AN ATTACHMENT FOR THE BOOM OF A CONSTRUCTION VEHICLE

BACKGROUND OF THE INVENTION

The application relates to an apparatus for handling and placing foundation devices, and/or pipes, and/or augers, into the ground Apparatuses for driving/pile-driving or rotationally driving foundation devices and pipes, or for drilling, are known. These apparatuses are available as separate implements, which may be self-propelled, comprising all of the necessary guides (holding and orientation functions) and drives. As such, they may be appropriate for their intended purposes and very convenient, but they are comparatively complex, in particular because, each of them can be only employed for use as part of a specific placement process, for example, for pile-driving, or drilling, or rotational driving. They are only cost-effective where a large number of similar placement processes must be performed on an ongoing basis.

Users who have only occasional need would consider such apparatuses only if they were in the form of attachments, which are attachable to known multifunctional construction vehicles, such as to the boom of an excavator. For this type of user, they are economical only in this way. Such an accessory unit is described in U.S. Pat. No. 6,942,430 B1 as an apparatus for placing pipes by way of rotational movement.

With the known apparatus, however, it is in fact difficult to maintain the desired driving direction, be it the perpendicular or at another desired angle, throughout the entire rotational driving process.

This is partially due to the fact that, as the rotational driving process progresses, the boom on which the rotational driving apparatus is mounted is lowered. The coupling point of the rotational driving tool at the boom follows a circular line about the pivot axis of the boom on the excavator. This means that, at the upper end, the rotational driving tool and the pipe or post to be rotationally driven-in thereby, or the auger, follows the coupling point, and unless a correction is made, the device will be displaced out of the intended direction, in the direction of extension of the excavator arm.

A similar faulty alignment occurs in the lateral orientation when the longitudinal axis of the pipe to be rotationally driven-in does not coincide with the movement plane of the excavator arm, for example because the excavator, and consequently the boom, are skewed when the rotational driving direction is perpendicular, or in cases where, while the excavator may be sitting straight, the rotational driving direction differs from the perpendicular is not aligned perpendicularly. Combinations of this error and the above-described error may result in excursion errors in the pipe that is to be driven-in rotationally, in each direction.

In addition, further sources of error include resistance in the ground, which displaces the pipe to be driven-in rotationally out of the intended alignment, and finally also operating errors on the part of the driver of the construction vehicle, such as, in particular, those which may occur when attempting to correct the above-described faulty alignments.

In the prior art, the above-described misalignments are compensated for primarily by way particular steering of the construction vehicle and/or the boom, and specifically by way of the driver moving the construction vehicle forward or back, depending on the situation, or rotating the vehicle, or shortening, extending or pivoting the boom.

This procedure, however, includes considerable inherent opportunity for error since the manner and the extent of the correction depend on the visual judgment of the operator and the precision of their steering movements, and also, perhaps in combination, the technology (precision of the steering control device). It is apparent that this kind of precision will often be inadequate, in particular in driving movements in rough terrain, and in light of the implements that are involved.

A partial solution to these problems is provided in U.S. Pat. No. 3,746,104. There, the length of a drilling boom can be hydraulically adjusted. This eliminates directional corrections by way of driving the construction vehicle forward and in reverse, which would otherwise be required, for example, so as to prevent the coupling point from drifting out of the longitudinal axis of the drilling device when the boom is lowered. In other words, the necessary correction is carried out by hydraulically changing the length of the boom, rather than by driving movements which are difficult to control.

However, this partial solution only solves the problem of faulty alignments in the direction of extension of the boom. For instance, if the boom is at an angle other than a right angle with respect to the placement direction of the drill, any change in the length of the boom will also be associated with a change in height. Depending on the direction of the movement, this will result in the drill being undesirably pulled out, or pushed in. In this situation, other faulty alignments must also be compensated for by corresponding driving movements of the excavator, and possibly by pivoting movements of the excavator body. In some instances, it may not be possible to compensate for them at all. This solution is, above all, highly complex because it requires a completely different boom from that which is commonly used.

A different partial solution to the problem is set forth in AT 387 424 B, which combines the gimbal mounting of a drilling apparatus with the capacity to adjust the length thereof hydraulically so as to thereby prevent movements of the boom and associated problems.

However, this solution only prevents problems resulting from movements of the boom. The document does not offer any solutions for other faulty alignments requiring readjustment of the apparatus. Again, the only option that remains is to readjust by way of the driving movements of the construction equipment or control movements of the boom.

In addition, this apparatus is also highly complex, and cannot readily be considered as an option for long foundation devices/pipes/augers, because these require a boom height which is usually not available for use with conventional construction vehicles.

SUMMARY OF THE INVENTION

In light of all of the above information, the invention provides an apparatus for handling, and for placing, foundation devices and/or pipes, and/or for drilling, as an attachment to be attached to the boom of a construction vehicle, wherein the apparatus prevents or corrects faulty alignments during driving (pile-driving), and/or rotational driving, and/or drilling, in a simple manner.

The present invention differs from the known apparatuses in that the point at which it is coupled to the boom can be displaced with respect to the drive head of the pile-driving, and/or rotational driving, and/or drilling apparatus, in at least a first direction, which is transverse to the longitudinal axis of the foundation device/pipe/auger. In this way, the boom, or more precisely the coupling point between the boom and drive head, is provided with the freedom to move at least in a first direction, out of the axis of the foundation device/pipe/ drill, without applying a force thereto laterally so at to pull it askew. Such compensation thus does not take place in the boom, nor by way of changing length thereof, but rather in the placement apparatus, or more precisely, at a point between the point at which the placement apparatus is coupled to the boom and the drive head.

Compared to the solutions according to the prior art, the present invention provides a variety of advantages whereby modification of the construction vehicle or of the boom is unnecessary in order to be able to compensate for error, and it is also no longer necessary to compensate for error by way of steering the construction vehicle, which has numerous disadvantages. Such compensation is achieved by way of an accessory part comprising the placement apparatus when the placement apparatus is mounted. This modification is comparatively compact, as compared, for example, to known ways of hydraulically adjusting the length of a drilling apparatus. Above all, any displacement, which is performed in a driven and controlled manner, can be carried out using (hydraulic) drives and controllers thereof, which are already found in modern construction vehicles, and are thus available for use with accessory units. In this way, the aforementioned displacement can be controlled manually by the operator in the simplest manner.

In a further embodiment, the coupling point may also be displaceable in a second direction, which is transverse to the first direction, in relation to the drive head. This allows for compensation of, not only faulty alignments in one direction, but also of errors in the second direction, whereby any combination of errors in the two directions can be appropriately compensated.

Since the primary source of error in alignment is the movement of the coupling point in the direction of extension of the boom, the first direction of free displaceability will preferably be the direction of extension of the boom.

The displaceability can be implemented in a particularly easy and compact manner, for instance, when the mounting is designed as a universal joint with respect to rotational driving apparatuses, whereby contrary to the known prior art, at least one first joint axis extends in a first direction, so as to produce the dispaceability, so that a first and a second joint part of the universal joint can be displaced relative to each other on the joint axis.

Thus, the first joint axis coincides with the first direction, which is the direction of extension of the boom.

However, to allow for complete readjustment, the second joint axis of the universal joint extends so that the second joint part and a third joint part of the universal joint can be displaced relative to each other thereon. By combining these two dispaceabilities, any movement of the coupling point out of the axis of the foundation device/pipe/drill, in whatever direction, can be compensated.

If the coupling point alone is to be provided with the mobility that is required in order to prevent the boom from skewing the foundation device/pipe/drill during movements of the same, it suffices that the universal joints simply be freely mobile on the axes so that a drive is not required.

With rough operations, it is not always possible to ensure the joint smoothness necessary for this purpose, and thus a suitable drive may be useful for displacement. In addition, a drive makes further functionalities possible. For example, the drive enables active alignment correction, the adjustment of the placement apparatus in a direction other than the perpendicular direction, and adjustments that allow a horizontal foundation device/pipe/drill to be coupled in this latter direction.

The driving operation can be carried out in this case by way of the drives which are already provided in modern construction vehicles, which are typically hydraulic drives, and thus no structural changes to the construction vehicle or the boom thereof are required.

Likewise, the drive, or drives, can be controlled manually by way of controllers associated therewith.

In the simplest case, a mercury tilt switch may be used for closed loop control or automatic control.

An inclinometer may be provided on the placement apparatus so as to indicate, to the operator, the current angular position of the placement apparatus relative to the foundation device/pipe/drill.

The placement apparatus may comprise at least one limitation on the pivot range thereof, which allows the apparatus to be moved into a substantially horizontal position, in order to connect with a foundation device/pipe/drill located on the ground, or into an appropriately inclined position for a placement that deviates from the perpendicular. As an alternative, or in addition, the placement apparatus may be designed, without major modifications, for driving/pile-driving and/or for rotationally driving foundation devices or pipes, and/or for ground boring, and/or rock drilling. If designed for ground boring, the transport of soil is contemplated.

BRIEF DESCRIPTION OF THE DRAWINGS

The subject matter of the invention will now be described in more detail with reference to the figures.

DETAILED DESCRIPTION OF THE INVENTION

Figures 1A, 1B:
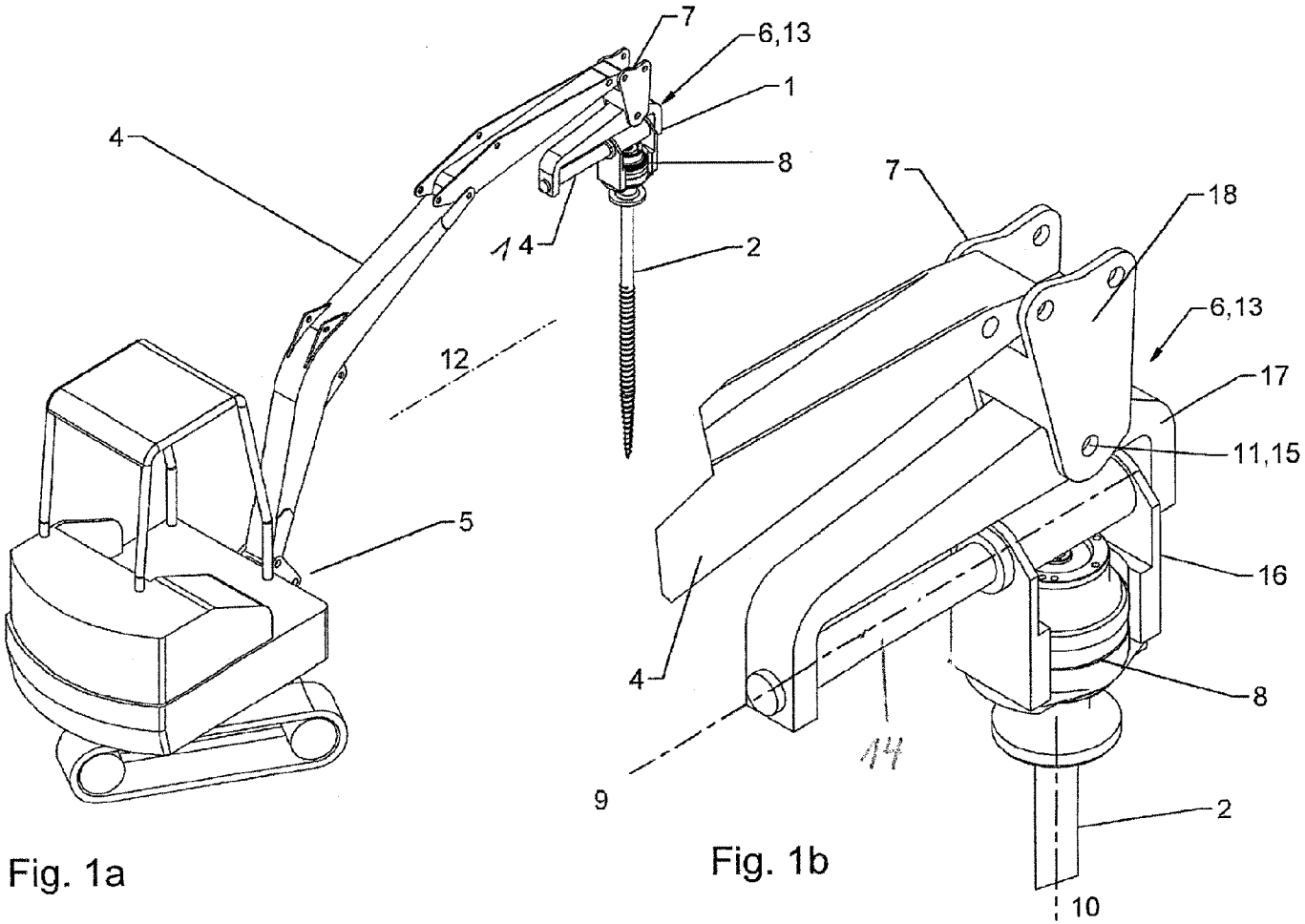
FIG. 1*a* shows a perspective view of a construction vehicle, comprising a placement apparatus according to the invention, which is mounted on the boom and includes a gimbal mounting having a universal joint with an extended first joint axis, a drive head and a foundation device/pipe/auger.
FIG. 1*b* shows in detail the mounting according to the invention in FIG. 1.

FIG. 1*a* shows a perspective view of a construction vehicle (5), comprising a placement apparatus (1) according to the invention, which is mounted on the boom (4) at the coupling point (7) thereof, and includes a gimbal (13) mounting (6) having a universal joint (13) with an extended first joint axis (14), which is directed in the direction of extension (12) of the boom (4), a drive head (8) and a foundation device/pipe/auger (2) mounted thereon.

FIG. 1*b* shows, as a detail from FIG. 1*a*, the placement apparatus (1) according to the invention, which is hinged to the boom (4) at the coupling point (7) thereof, and has a foundation device/pipe/auger (2) mounted thereon, comprising a drive head (8) and a mounting (6) configured as a universal joint (13) having joint parts (16, 17, 18), and a first and a second joint axis (14, 15) of the universal joint (13), wherein the first joint axis (14), which is oriented in a first direction (9), which is transverse to the longitudinal axis (10) of the foundation device/pipe or auger (2), extends so that the first and the second joint part (16, 17) of the universal joint can be displaced relative to each other thereon, so as to displace the coupling point (7).

Figure 2:
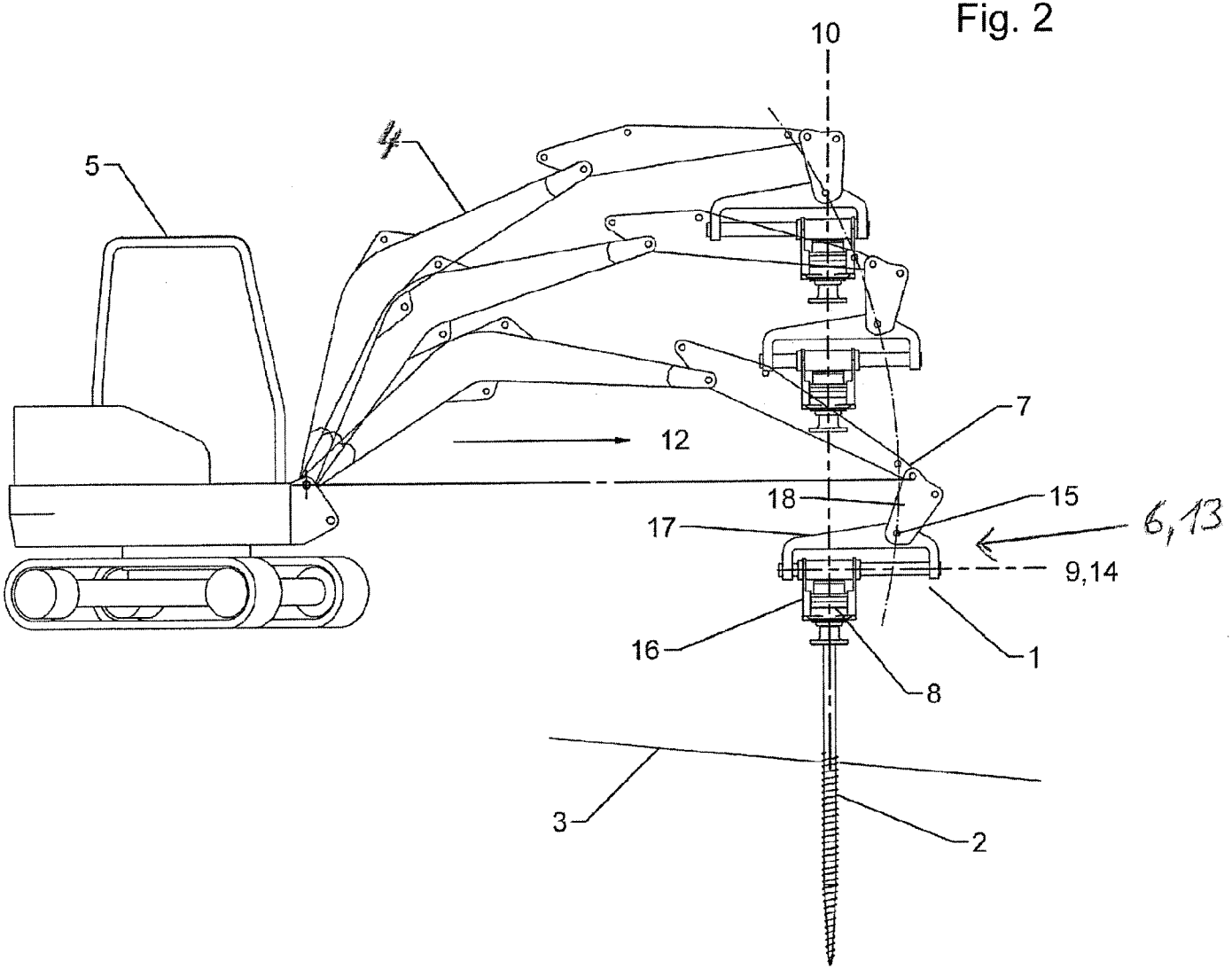
FIG. 2 shows a side view of the construction vehicle in FIG. 1, and illustrates the sequence of motions of the boom.

FIG. 2 shows a side view of the construction vehicle (5) according to FIG. 1, comprising the placement apparatus (1) according to the invention, which is mounted to the boom (4) at the coupling point (7) thereof, and comprises a drive head (8) and a foundation device/pipe/auger (2), which is mounted thereon and partially rotationally driven-into the ground (3). The mounting (6) is configured as a universal joint (13) having first and second joint axes (14, 15) and first, second and third joint parts (16, 17, 18). The first joint axis (14) of the universal joint (13), which runs in a first direction (9) in the direction of extension (12) of the boom (4), is extended. The figure shows in particular how, when the boom (4) is lowered, the coupling point (7) moves out of the longitudinal axis (10) when the foundation device/pipe/auger (2) is placed, and how this movement is compensated for by way of displacement of the first and second joint parts (16, 17) relative to each other on the first joint axis (14) of the universal joint (13), so that the alignment of the foundation device/pipe/auger (2) is not influenced.

Figure 3B:
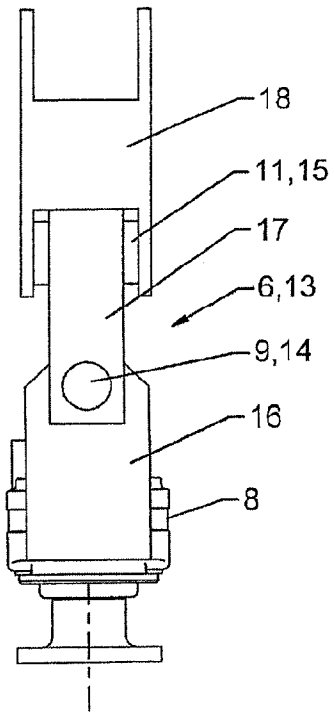
FIG. 3*b* shows the mounting according to FIGS. 1*a*, 1*b* and 2 as seen in the direction of extension of the boom or the direction opposite thereto.
Figure 3A:
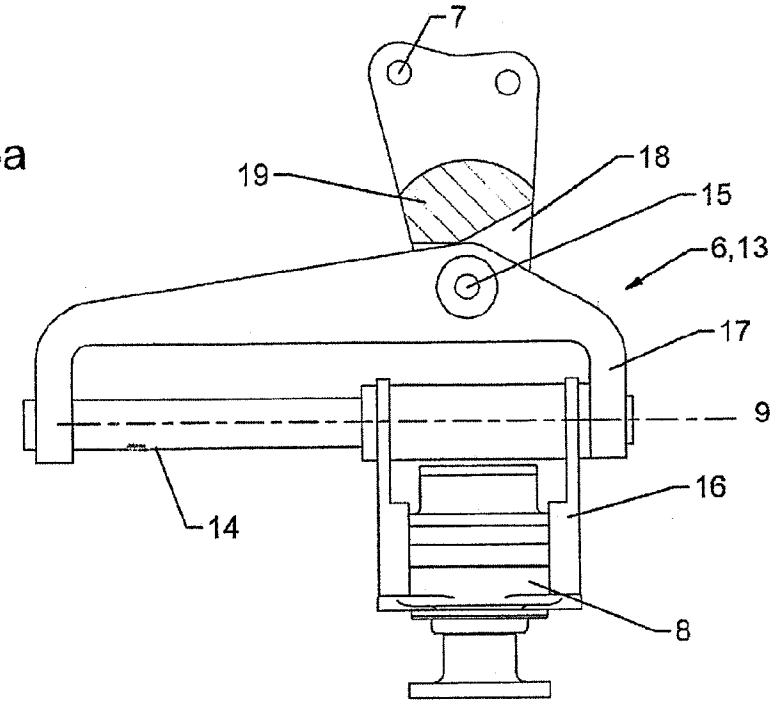
FIG. 3*a* shows a side view of the mounting according to FIGS. 1*a*, 1*b* and 2.
Figure 3C:
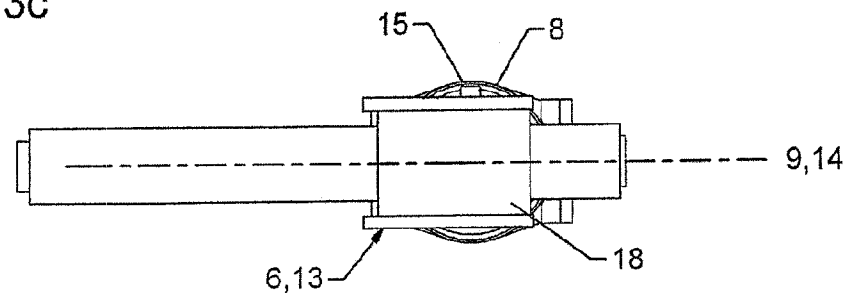
FIG. 3*c* shows a top view of the mounting according to FIGS. 1*a*, 1*b* and 2.

FIGS. 3*a-c* show different views of the placement apparatus (1) according to FIGS. 1*a*, 1*b* and 2:

FIG. 3*a* shows a side view comprising the drive head (8) and mounting (6) as a universal joint (13) having first and second joint axes (14, 15) and first, second and third joint parts (16, 17, 18) of the universal joint (13), as well as the coupling point (7) for hinged connection to the boom (4). Also shown are the first direction (9) and the stop (19) for limiting the pivot range of the placement apparatus (1), which makes it possible to bring the apparatus into a horizontal or similar position for receiving horizontal foundation parts/pipes/augers.

FIG. 3*b* shows the placement apparatus (1), as seen in the direction of extension (12) of the boom (4) or the direction opposite thereto, comprising the mounting (6) and drive head (8), joint axes (14, 15) oriented in the first and second directions (9, 11), and first, second and third joint parts (16, 17, 18).

FIG. 3*c* shows a top view of the placement apparatus (1) comprising the drive head (8) and the mounting (6) as a universal joint (13), the third joint part (18), the first joint axis (14) of the universal joint (13) oriented in the first direction (9), and the second joint axis (15).

Figure 4B:
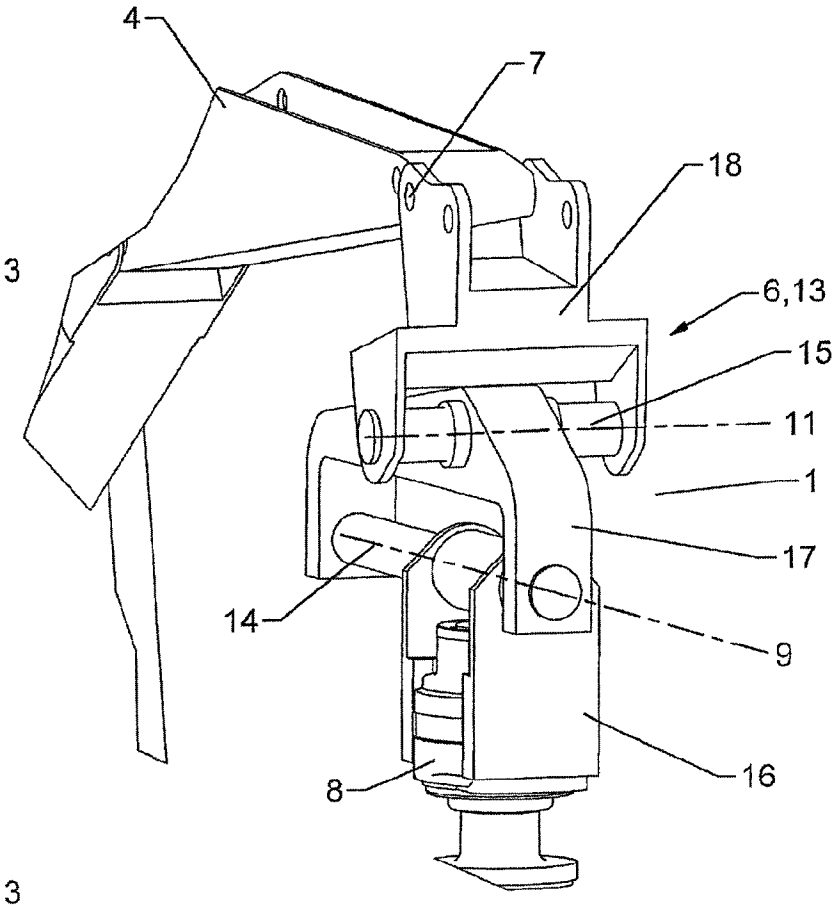
FIG. 4*b* shows in detail the mounting according to the invention in FIG. 4*a;*
Figure 4A:
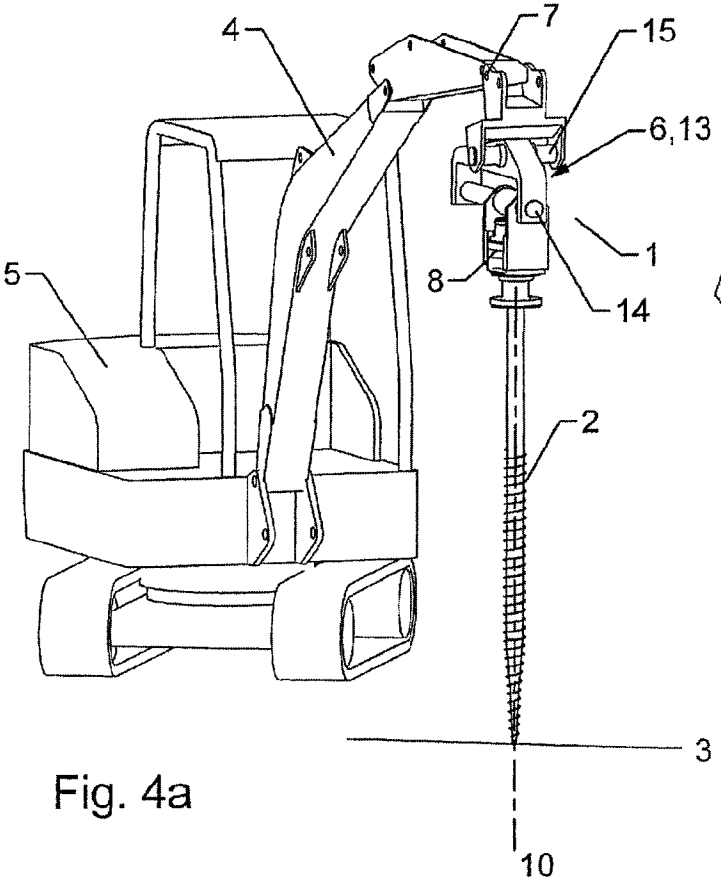
FIG. 4*a* shows a perspective view of a construction vehicle, comprising a placement apparatus according to the invention which is mounted on the boom and includes a gimbal mounting having a universal joint with extended first and second joint axes, a drive head and a foundation device/pipe/auger.

FIG. 4*a* shows a perspective view of a construction vehicle (5) comprising a placement apparatus (1) according to the invention which is mounted to the boom (4) at the coupling point (7) and comprises the drive head (8) and the mounting (6), having the foundation device/pipe/auger (2) mounted on the drive head (8). The mounting (6) is configured as a universal joint (13) and comprises extended first and second joint axes (14, 15) of the universal joint (13).

FIG. 4*b* shows in detail the placement apparatus (1) of FIG. 4*a* according to the invention, which is hinged to the coupling point (7) of the boom (4) and includes the drive head (8) and a mounting (6), which is configured as a universal joint (13) and comprises first, second, and third joint parts (16, 17, 18), which can be swiveled relative to each other on the extended first and second joint axes (14, 15) and displaced relative to each other longitudinally in the direction of the axes (14, 15), in a first direction and in a second direction (9, 11).

Figures 5A, 5B:
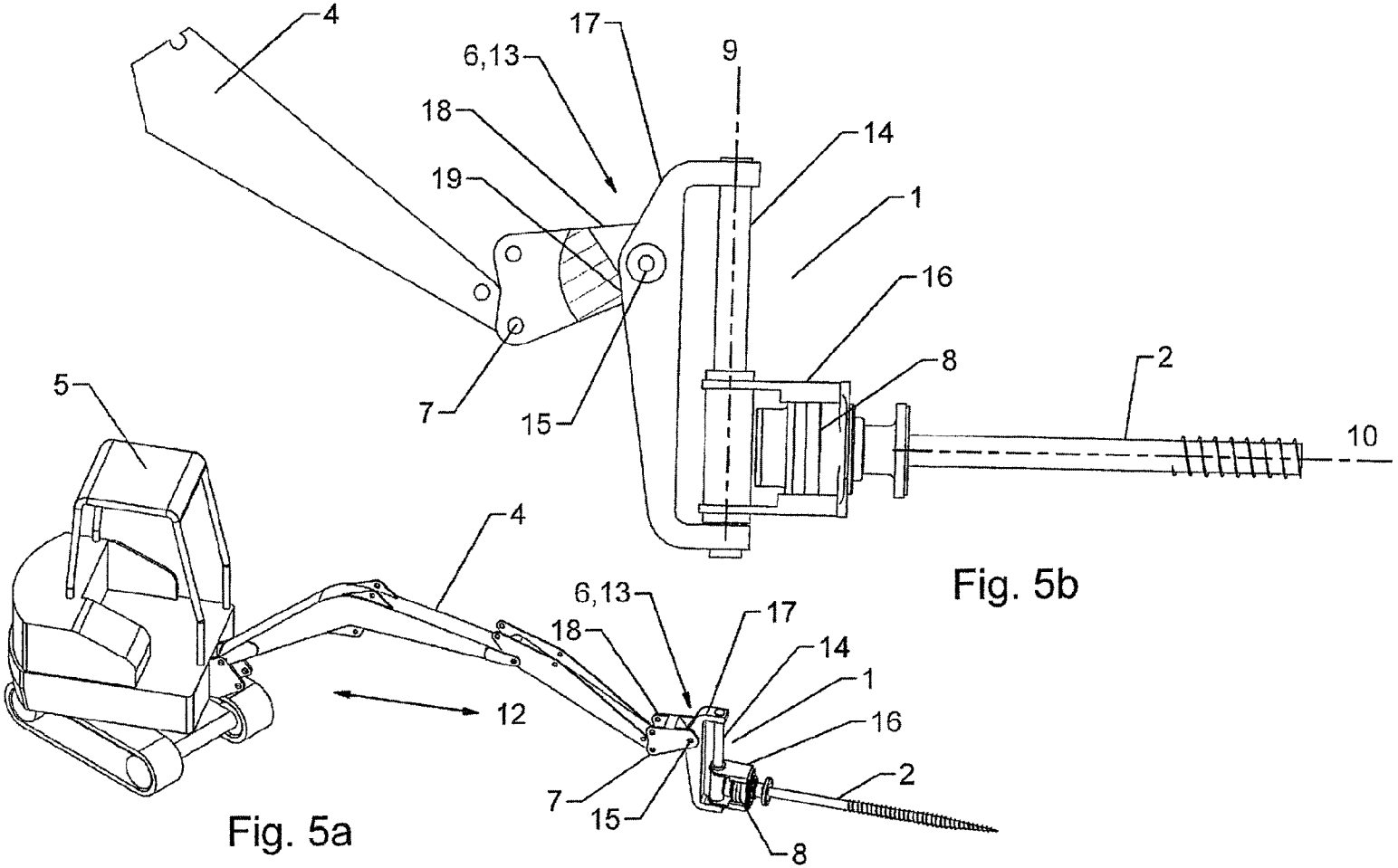
FIG. 5*a* shows a construction vehicle according to FIG. 1*a* in an orientation for receiving a horizontal foundation device/a horizontal pipe or auger.
FIG. 5*b* shows a detail from FIG. 5*a*, including a stop for limiting the pivot range of the placement apparatus for receiving horizontal foundation devices/pipes/augers.

FIG. 5*a* shows the construction vehicle of FIG. 1*a* in an orientation for receiving a horizontal foundation device/pipe/auger (2), comprising a boom (4) which is extended in the direction of extension (12) thereof and a placement apparatus (1) hinged thereon at the coupling point (7), the apparatus comprising the drive head (8) and the mounting (6) configured as a universal joint (13) having joint parts (16, 17, 18) and joint axes (14, 15). The mounting is oriented such that the first (extended) joint axis (14) assumes a first direction (9), which is substantially vertical. In this way, the drive head (8), the longitudinal axis of which is oriented transversely to the first joint axis (14) of the universal joint (13), is moved into a substantially horizontal position, so that it can be coupled without difficulty to a likewise horizontally supported foundation device/pipe/auger (2) stored, for example, as supply material on the ground. FIG. 5*b* shows a detail from FIG. 5*a*, namely the boom (4) having the placement apparatus (1) hinged thereon at the coupling point (7), the apparatus comprising the drive head (8) and the mounting (6) configured as a universal joint (13) having joint parts (16, 17, 18) and joint axes (14, 15). The mounting is oriented so that the first (extended) joint axis (14) assumes a first direction (9), which is substantially vertical. In this way, the drive head (8), the longitudinal axis of which is oriented transversely to the first joint axis (14) of the universal joint (13), is moved into a substantially horizontal position, so that it can be coupled without difficulty to a foundation device/pipe/auger (2) which is likewise horizontally supported in the longitudinal axis (10) thereof and, for example, stored as supply material on the ground. FIG. 5*b* additionally shows a simple means for achieving this mounting position, which is to say, by way of a stop (19) which limits the movement of the pivot range of the placement apparatus so that it must follow the corresponding adjustments of the boom.

Such pivot range limitation can analogously be used to move the placement apparatus into an inclined placement position that deviates from the perpendicular.

A corresponding result can, of course, also be achieved by way of appropriately controlling the mounting (6) using appropriate drives and controllers thereof, as discussed.

The invention claimed is:

1. An apparatus for handling and positioning foundation devices, and/or pipes, and/or augers that is attachable to the boom of a construction vehicle, the apparatus comprising:

a mounting for hingedly connecting the apparatus to a coupling point of the boom that is a point of direct attachment of the mounting to the boom; and a drive head rigidly connected to the mounting and configured as a rotational driving, and/or drilling, and/or impact drilling, and/or pile-driving drive, the foundation device/pipe/auger being couplable to the drive head so as to allow handling and actuation of the foundation device/pipe/auger, the coupling point being laterally displaceable with respect to the drive head in at least a first direction that is transverse to the longitudinal axis of the foundation device/pipe/auger upon movements of the boom throughout the entire rotational driving process of the drive head so as to provide the coupling point with the freedom to move in the at least a first direction, which is out of said longitudinal axis of the foundation device/ pipe/auger, without applying a force laterally thereto that would pull the foundation device/pipe/auger askew.

2. The apparatus according to claim 1, wherein the coupling point can be displaced with respect to the drive head in a second direction, the second direction being transverse to the first direction.

3. An apparatus according to claim 1, wherein the first direction is the direction of extension of the boom.

4. An apparatus according to claim 1, wherein the mounting comprises a universal joint, the joint comprising at least one first joint axis that extends so that a first and a second joint part are displaceable thereon relative to each other so as to displace the coupling point.

5. The apparatus according to claim 4, wherein the first joint axis comprises the first direction.

6. The apparatus according to claim 5, wherein a second joint axis extends so that the second and a third joint part of the universal joint can be displaced thereon relative to each other.

7. An apparatus according claim 6, wherein at least one drive is provided for longitudinal displacement of the first, second and third joint parts relative to the first and second joint axes.

8. The apparatus according to claim 7, wherein the at least one drive is controlled by open or closed loop control.

9. The apparatus according to claim 8, wherein the drive comprises a rotational drive that comprises at least one mercury tilt switch that provides open/closed loop control.

10. An apparatus according to claim 4, further comprising at least one limitation of the pivot range of the placement apparatus so as to allow the placement apparatus to be moved into a substantially horizontal position so as to connect a foundation device/pipe/auger located on the ground, or into an appropriately inclined position that deviates from the perpendicular.

* * * * *